US006502714B1

(12) United States Patent
Lèi

(10) Patent No.: US 6,502,714 B1
(45) Date of Patent: Jan. 7, 2003

(54) NOVELTY DRINKING APPARATUS

(75) Inventor: Ping Fai Lèi, Aberdeen (HK)

(73) Assignee: Global Win Industrial Limited, Aberdeen (HK)

( * ) Notice: Subject to any disclaimer, the term of this patent is extended or adjusted under 35 U.S.C. 154(b) by 0 days.

(21) Appl. No.: 09/574,048

(22) Filed: May 18, 2000

(51) Int. Cl.[7] ..... A47G 19/22
(52) U.S. Cl. ..... 220/709; 220/501; 239/33
(58) Field of Search ..... 220/709, 501, 220/505, 708, 713; 239/33

(56) References Cited

U.S. PATENT DOCUMENTS

| | | | | | |
|---|---|---|---|---|---|
| 3,782,028 | A | | 1/1974 | Kelly | 46/41 |
| 3,879,885 | A | | 4/1975 | Fabricant | 46/44 |
| 4,211,024 | A | | 7/1980 | Nickell | 40/406 |
| 5,339,982 | A | * | 8/1994 | Tardie | 220/708 |
| 5,361,987 | A | | 11/1994 | Matheussen et al. | 239/33 |
| 5,503,296 | A | * | 4/1996 | DiBaggio | 220/708 |
| 5,518,142 | A | | 5/1996 | Lin | 220/707 |
| 5,582,320 | A | * | 12/1996 | Lin | 220/708 |

FOREIGN PATENT DOCUMENTS

| | | |
|---|---|---|
| DE | 36 11 629 | 10/1986 |
| GB | 2 359 726 | 9/2001 |
| WO | WO 94/17691 | 8/1994 |

OTHER PUBLICATIONS

International Search Report dated Jun. 4, 2001, for corresponding International application PCT/NZ01/00042.
UK Patent Office Search Report, Appl. No. GB 0106973.1, Sep. 2001 (1 page).

* cited by examiner

*Primary Examiner*—Mickey Yu
*Assistant Examiner*—Troy Arnold
(74) *Attorney, Agent, or Firm*—Cooper & Dunham LLP

(57) ABSTRACT

A novelty drinking apparatus. The apparatus has a liquid reservoir with at least one liquid outlet ("first liquid outlet(s)"), ducted by a first ducting from at least one inlet ("first inlet(s)") in the liquid pulled within the reservoir, at least one liquid outlet ("second liquid outlet(s)") ducted by a second ducting from at least one inlet ("second inlet(s)") outside of said reservoir yet in the vicinity of said first liquid outlet(s), and a chamber which holds said first liquid outlet (s) and said second liquid inlet(s) in a separated condition within said chamber. In the operation of the device, a suction applied at, on or about said second liquid outlet(s) induces a flow of liquid of liquid pulled from the liquid reservoir through said first and second ducting. The first ducting is arranged to direct the flow of liquid immediately before said first liquid outlet(s) in a direction to said second liquid inlet(s), such that the inertia of liquid leaving the first ducting through said first liquid outlet(s) establishes an unducted portion of said flow of liquid from said first liquid outlet(s) to said second liquid inlet(s).

5 Claims, 5 Drawing Sheets

NOVELTY DRINKING APPARATUS

The present invention relates to a drinking apparatus, and in particular but not solely to a drinking apparatus to be used as a novelty item.

Many different forms of novelty drinking containers are known. Such include for example those shown in U.S. Pat. No. 3,879,885 there is a container which has an inlet and outlet straw. The application of suction at the outlet straw will, when the inlet straw is placed in a cup containing liquid, generate a fountain of liquid within the container.

In U.S. Pat. No. 4,211,024 there is described a drinking straw which has an expanded mid section to provide a surface on which advertising or the like can be placed. The expanded section is first filled with liquid drawn up from the lower section of the straw, before the liquid advances through the upper section to the mouth of the user.

Likewise in U.S. Pat. No. 5,361,987, there is shown a drinking straw having an expanded section which is filled with liquid prior to advancing out through the upper section. All this prior art is of straw like apparatus for location with a separate cut or glass or cup of liquid. The novelty effect that these specification teach is either of filling of a compartment prior to displacement from the apparatus, of a fountain effect of a disbursed flow of liquid.

It is therefore an object of the present invention to provide a drinking apparatus which will at least provide the public with a usefull choice.

Accordingly in a first aspect the present invention consists in a drinking apparatus comprising or including liquid reservoir means defining a liquid reservoir having at least one liquid outlet ("first liquid outlet(s)"), ducted by ducting from at least one inlet ("first inlet(s)") in the liquid pulled within the reservoir, at least one liquid outlet ("second liquid outlet(s)"), ducted by ducting from at least one inlet ("second inlet(s)") outside of said reservoir yet in the vicinity of said first liquid outlet(s), and means to hold said first liquid outlet(s) relative to said second liquid inlet(s) in such a way as to enable suction applied at, on or about said second liquid outlet(s) to induce an unducted liquid flow of liquid duct from the liquid pulled within the reservoir between said first liquid outlet(s) and said second liquid inlet(s).

Preferably said means to hold is a chamber.

Preferably said chamber is substantially sealed save for said at least one first liquid outlet(s) and said at least one second inlet(s).

Preferably said chamber holds said at least one first liquid outlet(s) and said at least one second inlet(s) in a condition such that the ducting at least immediately before said at least one first liquid outlet(s) is substantially in line with the at least one second inlet(s).

Preferably said chamber holds said at least one first liquid outlet(s) and said at least one second inlet(s) in a condition such that the ducting at least immediately before said at least one first liquid outlet(s) is substantially aligned with the ducting at least immediately after at least one second inlet(s).

Preferably each of said at least one first liquid outlet(s) has a separate ducting.

Preferably there is one said second inlet.

Preferably there is one said first liquid outlet.

Alternatively there is at least two first liquid outlets.

In the alternative there is one said inlet.

Preferably said chamber is smaller than the liquid reservoir means.

Preferably said chamber and said liquid reservoir are directly engaged to each other such that said chamber is located for use above said reservoir.

Preferably said reservoir is a container with a mouth region opening which can be substantially sealed for use by a portion of said means to hold save for at least one pressure equalization opening for said reservoir means.

Preferably said at least one first liquid outlet(s) is provided though said means to hold, at a portion thereof which provides said seal to the reservoir means mouth region.

Preferably said at least one first inlet(s) is provided for use at the lower region of said reservoir means.

Preferaby said pressure equalization means is an aperture extending from the outer bounds of the reservoir means, into said reservoir means.

Alternatively said pressure equalization means is an opening to the atmosphere through the interface of the mouth region of the reservoir means and the means to hold.

Preferably said ducting between said first liquid inlet and said first liquid outlet is substantially straight.

Preferably said reservoir means and said means to hold are threadingly engagable to each other.

Alternatively said reservoir means and said means to hold are snap fit engagable to each other.

Alternatively said reservoir means and said means to hold are bayonet engagable to each other.

Preferably said reservoir means and said means to hold are of the same outline shape when viewed in their engagement direction.

Preferably said reservoir means and said means to hold are of cylindrical shape.

Preferably said reservoir means is substantially rigid.

Preferably the flow area from said at least one first liquid outlet is smaller than the effective flow area of said at least one second inlet.

In a second aspect the present invention consists in a drinking apparatus comprising or including liquid reservoir means defining a liquid reservoir having at least one liquid outlet ("first liquid outlet(s)"), ducted by ducting from at least one inlet ("first inlet(s)") in the liquid pulled within the reservoir, means to hold at least one second liquid outlet(s) relative to said first liquid outlet(s) in such a way as to enable suction applied at, on or about said second liquid outlet(s) to induce at least a partially unducted liquid flow of liquid ducting from the liquid pulled within the reservoir between said first liquid outlet(s) and said second liquid outlet(s).

Preferably said at least one second liquid outlet(s) is provided as an opening in a wall of said means to hold.

Alternatively said at least one second liquid outlet(s) is provided at the distal end of a ducting from at least one liquid inlet provided to the means to hold.

Preferably said means hold is a sealed chamber save for said at least one liquid outlet of said liquid reservoir means, and said at least one second liquid outlet(s).

In a further aspect the present invention consists in a drinking vessel comprising:

a container divided into a lower most compartment to retain a liquid, and at least one compartment above said lower most compartment, at least one duct (the "lower most duct(s)") having at least one inlet extending to the lower most regions of said lower most compartment and having at least one outlet opening ("first outlet opening(s)") provided into the said at least one compartment above, said at least one compartment above into which said outlet of said lower most duct is provided, also including at least one outlet opening ("second outlet opening(s)")

wherein said at least one compartment above is holds at least one second outlet(s) relative to said first liquid outlet(s) in such a way as to enable suction applied at, on or about said second liquid outlet(s) to induce at least a partially unducted liquid flow of liquid ducting from the liquid pulled within the lower most compartment between said first liquid outlet(s) and said second liquid outlet(s).

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

One preferred form of the present invention will now be described with reference to the accompanying drawings in which;

FIG. 1 is a perspective view of one preferred form of the drinking apparatus of the present invention, FIG. 2 is an exploded view of the drinking apparatus of FIG. 1 illustrating an upper and reservoir means of the drinks container, FIG. 3 is a side view of the chamber of the drinking apparatus, FIG. 4 is a sectional view through a vertical cross section of the article of FIG. 1, FIG. 5 is a sectional view of an alternative arrangement of the present invention through a vertical section, FIG. 6 is a sectional view through an alternative arrangement wherein there is illustrated provisions for establishing a plurality of unsupported water columns, FIG. 7 is a sectional view in sectional direction AA of FIG. 6, FIG. 8 is a sectional view through yet an alternative form of the present invention, FIG. 9 is a sectional view through section B—B of FIG. 8, FIG. 10 is yet an alternative of the drinking apparatus, FIG. 11 is still a further alternative of the drinking apparatus, FIG. 12 is yet another alternative arrangement of the present invention.

Figure 1:
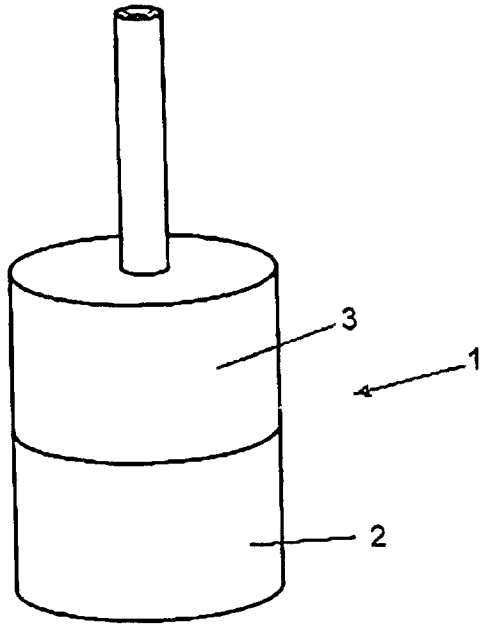

With reference to FIG. 1 the drinking apparatus 1 preferably consists of a liquid reservoir means 2 defining a liquid reservoir 17. The reservoir has at least one liquid outlet referred to as the first liquid outlet(s) 12. This is ducted by ducting 4 from at least one inlet referred to a the first inlet(s) 13 through which the liquid within the reservoir may be pulled. The apparatus also includes a means to hold at least one second liquid outlet(s) 14 relative to said first liquid outlet(s) 12. The means to hold is preferably a chamber defining means and holds the second liquid inlet relative to the first liquid outlet in such a way as to enable suction applied at, on or about said second liquid outlet(s) to induce at least a partially unducted liquid flow of liquid ducting from the liquid pulled within the reservoir.

Figure 12:
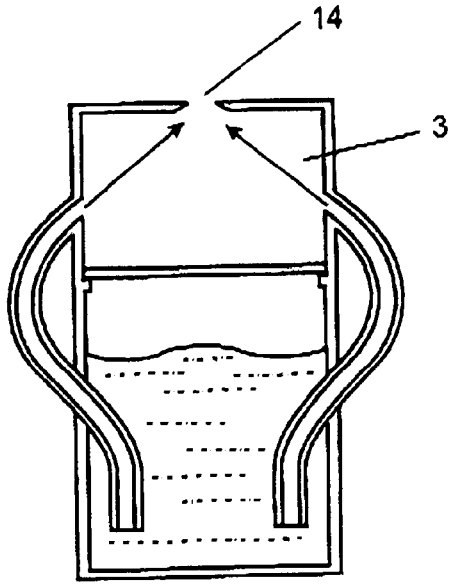
Figure 13:
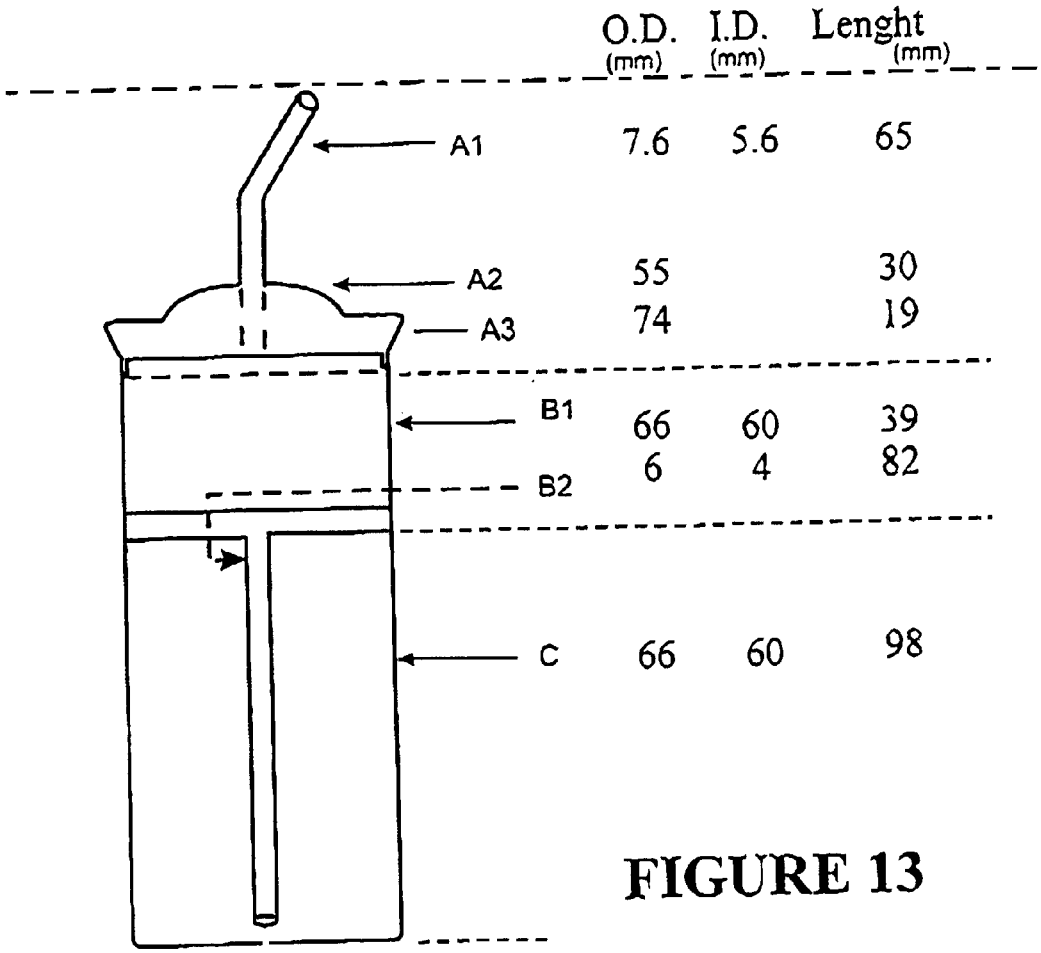
FIG. 13 illustrates one preferred form of the present invention with dimension lines to illustrate a configuration which will allow for the unsupported column of water to be established.
Figure 14:
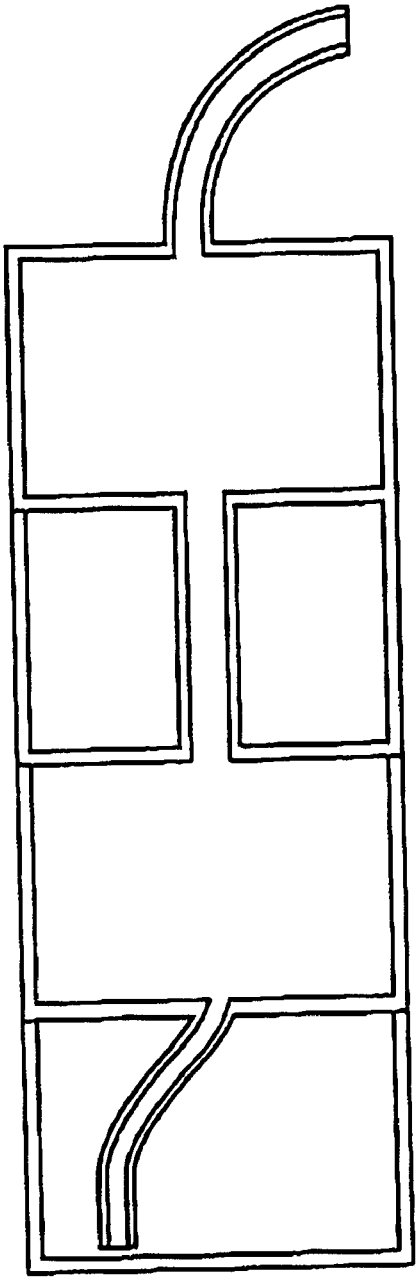
FIGS. 14 and 15 illustrate even further alternatives to the present invention.
Figure 15:
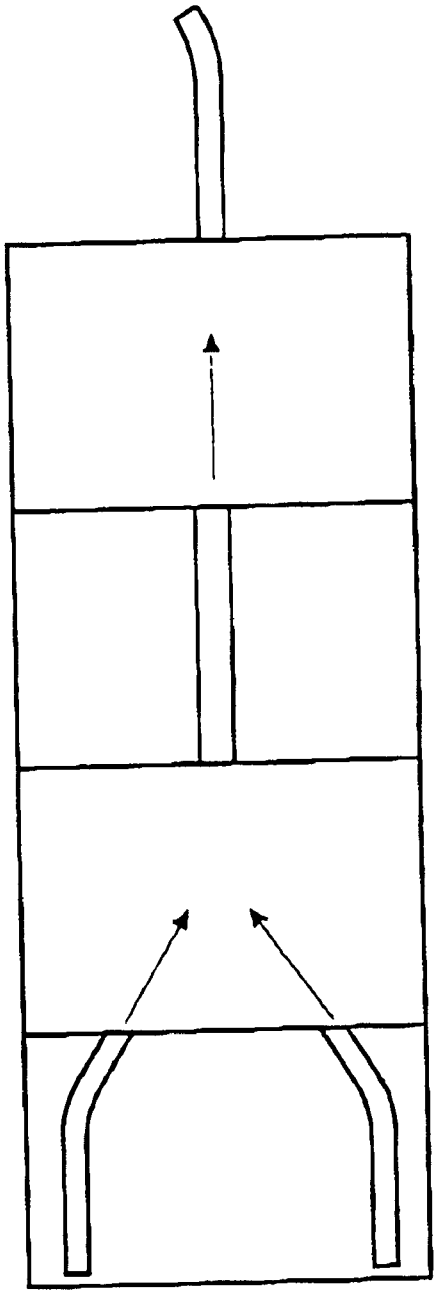

Between the second liquid outlet and the first liquid outlet, the flow is partially unducted. In for example FIG. 4, there is a portion of the flow between second liquid outlet and the first liquid outlet which is ducted by a ducting or conduit 6. In FIG. 12 however, there is not such upper ducting provided to the second liquid outlet.

Figure 5:
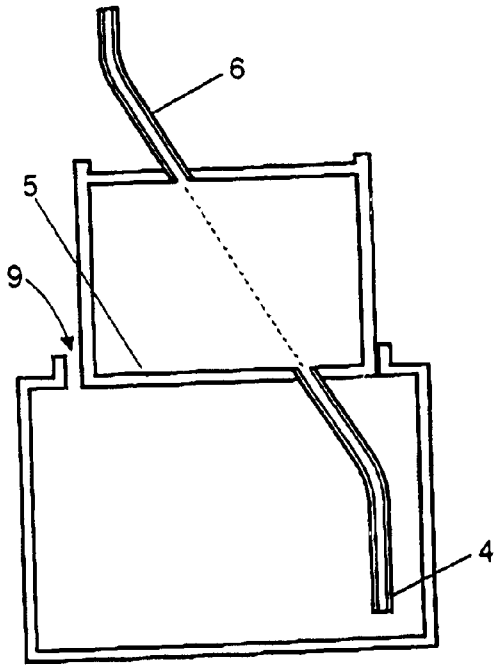

In the most preferred form the chamber and the reservoir means are substantially of a corresponding external shape for example of a circular shape so that the appearance of the product from the outside is of a continuous body. FIG. 5 illustrates an alternative to this preferred arrangement wherein the outer shape includes a step feature. Other alternatives are also possible.

Figure 2:
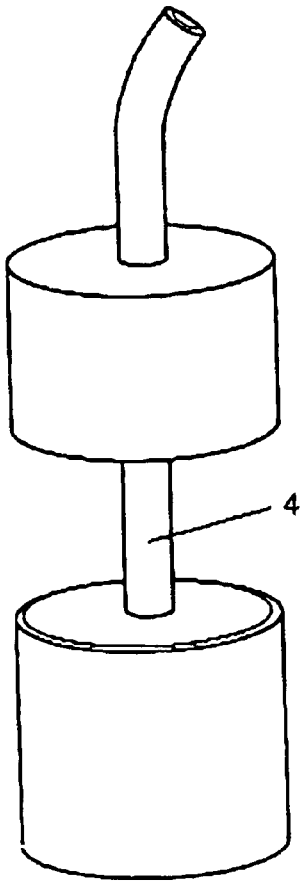
Figure 3:
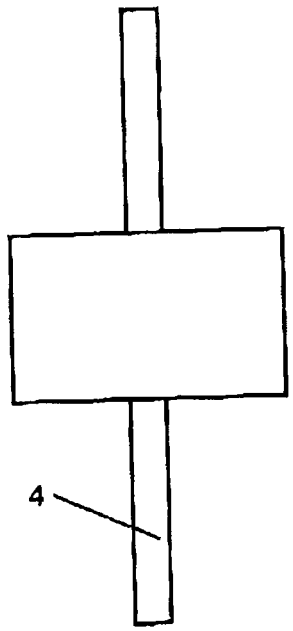

With reference to FIGS. 2 and 3, the ducting 4 extends downwardly to an opening (the first outlet) from the chamber into the reservoir. As the reservoir means is adapted to receive and contain liquid such as soft drink or water or the like, and this is to be dispensed from this reservoir via the at least one ducting 4, the ducting 4 extends from a first outlet 12 into the reservoir means to a first liquid inlet 13, which is preferably proximate to the lower most regions of the reservoir means. This will ensure that substantially all of the liquid contained in the reservoir means can be drawn through the ducting 4.

The chamber is sealed and preferably air tight save for the openings provided by the at least one first liquid outlet into the chamber and an the at least one second outlet 14.

The chamber may be provided with a lid provision 7 which can be searingly engaged to the upper mouth region 8 of the chamber. Alternatively processes may be utilized in the manufacturing of the present invention wherein this chamber is of a one piece member as for example as shown in FIG. 5. Where a lid is provided, this lid must securely and sealingly engage with the chamber. This may for example be achieved by a tapered mouth region 8 engagable with a complementary tapered mouth engagable portion of the lid 7. Further features such as annular ribs or a treaded type of engagement may also be provided for this purpose.

The apparatus is preferably of a nature where the reservoir has a chamber engagable mouth regions, such that when it is engaged with the chamber the mouth region of the reservoir is substantially sealed therewith the preferred cylindrical shape of the reservoir and the chamber means the apparatus preferably has the overall shape of a tall glass with a lid or a can of soft drink or the like.

Figure 4:
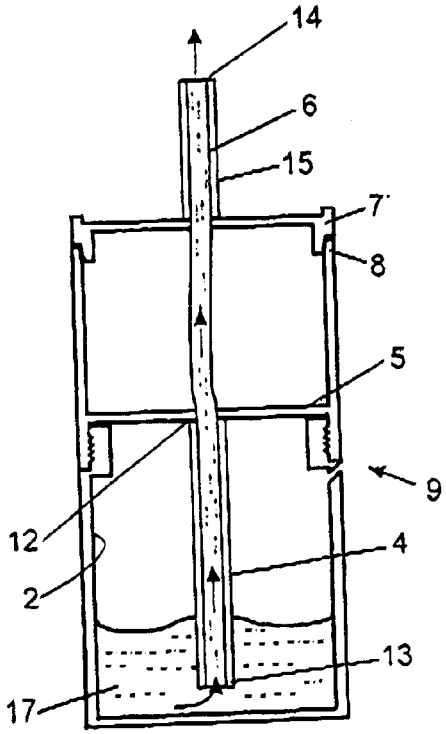

In operation of the novel drinks container as for example shown in FIG. 4, a person can provide suction to the second outlet by placing this to the mouth of the user.

As the reservoir means preferably has at least one pressure equalizing aperture 9 or other opening or the like to allow for air to be displaced into the reservoir means, liquid can be displaced from the reservoir through the ducting 4 and into the chamber as an unsupported column or unducted flow of liquid.

Upon the application of suction to the second outlet (whether directly by the user or indirectly via other chambers or the like) the only way in which pressure in the chamber can move towards equalization is for liquid to be drawn through the ducting 4 to move and upwardly, and out through second outlet.

Liquid momentum being drawn up through the ducting 4 is preferably directed towards the upper opening of the chamber and thereby exits the chamber without substantially flowing astray from being an unsupported column between the openings of the chamber.

The fact that the chamber is substantially sealed to any other flow of fluid ensures that a maximum suction pressure is transferred to the ducting 4 to draw the liquid of the reservoir means upwardly therethrough.

Figure 6:
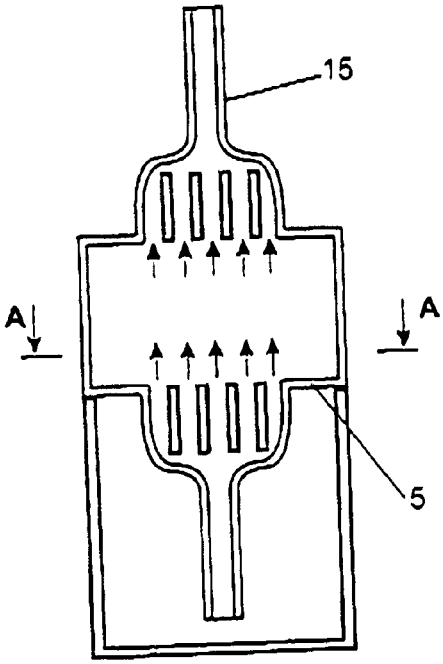
Figure 7:
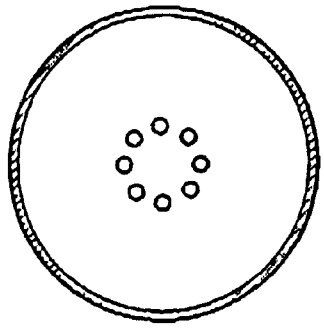
Figure 8:
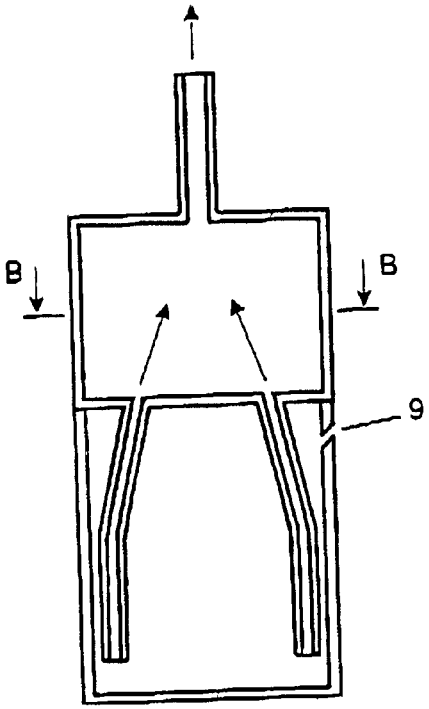
Figure 9:
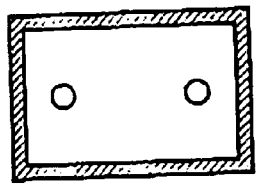

FIG. 5 illustrates that the present invention can be provided wherein a non-vertical alignment of the two openings of the chamber occur. Likewise the container of FIG. 4 can be utilized on an angle wherein the aligned ductings are not FIG. 6 illustrates an arrangement wherein a single lower ducting 4 and preferably also single upper 15 ducting can be provided with diversions/contractions which extend/reduce to provide a plurality of openings in the upper and lower parts of the chamber. A manifold type arrangement or similar may perhaps be used in this respect. Alternatively a plurality of ductings to provide such effect may be provided as for example shown in FIG. 8. Indeed in FIG. 8 there is shown an illustration where there are two lower ductings 4 converging the flow of fluid therefrom into the chamber to a single upper opening, (second inlet opening).

To reduce spillage of any flow of the unsupported column of water in the chamber, the most preferred form of the present invention incorporates a smaller opening of the lower ducting into the chamber than the opening from which the upper ducting preferably extends from the upper or second inlet opening of the chamber.

In FIGS. 4, 6, 8 and 10 the pressure equalization means of the reservoir means is preferably an opening directly into the reservoir means from external of the container. Such an opening may preferably be provided in the wall of the reservoir means or may be provided as a gap between the junction of the upper and reservoir means in the forms of the invention shown in FIG. 5. Such may be achieved by an imperfect sealing between the upper and lower members providing the upper and reservoir means. Where a flexible liquid reservoir is used, such pressure equalization means way not be necessary.

Figure 11:
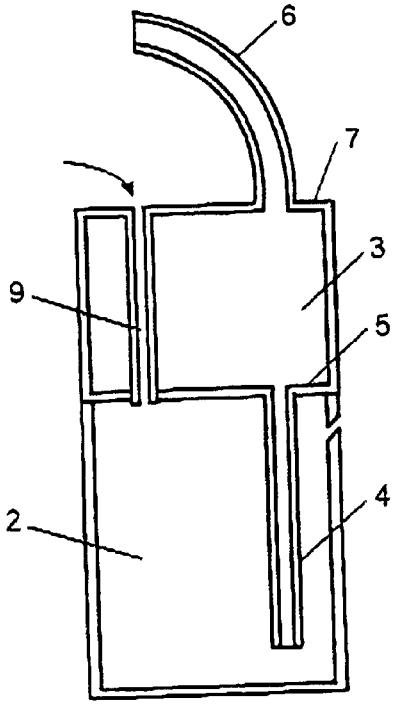

In an alternative form as shown in FIG. 11, the equalization means 9 may be a ducting which extends from an opening in the junction 5 between the chamber and reservoir to an opening in the chamber. As shown in FIG. 11 this opening in this chamber is on the lid 7 but may alternatively be through any other wall section of this compartment not extending back into this reservoir means.

Figure 10:
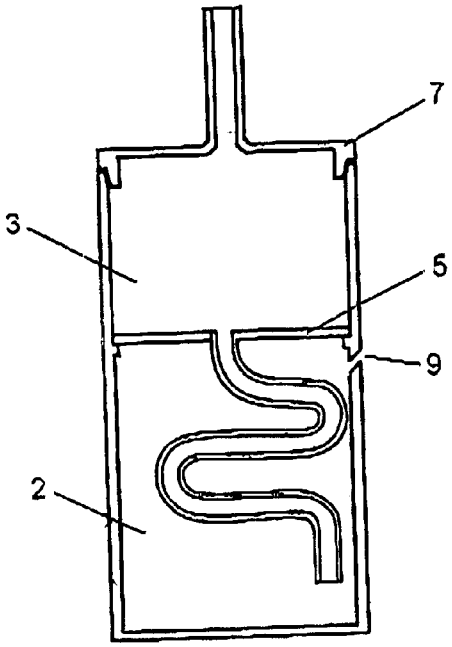

In an alternative the apparatus 1 is of a single container which is separated into at least two compartments 2, 3 by a division providing means 5, as shown in FIG. 10.

The apparatus shown in FIG. 12 does not have a, or significant upper duct. The chamber may be provided with merely an outlet (second outlet) to which the mouth of a user can be placed to provide suction. This version of the invention shows that the ducting between the first inlets and first outlets need not place the first outlets at the junction between the reservoir and the chamber.

The flow of liquid from the ducting 4 is preferably of a momentum which has sufficient speed to reach the second inlet or chamber upper opening, and is preferably also of a direction, directed at the second inlet/opening. At least in one broad sense of this aspect, it is preferably at least that portion of the ducting immediately before the first outlet which is vectored in the direction of the second inlet/opening. Preferably the portion of the ducting immediately extending from the second inlet may also be of the same vectoring as other duct.

What is claimed is:

1. A novelty drinking apparatus comprising:

(a) a liquid reservoir having a first liquid outlet, ducted by a first ducting from a first inlet in a liquid within the reservoir, (b) a second liquid outlet ducted by a second ducting from a second inlet outside of said reservoir yet in the vicinity of said first liquid outlet, (c) a chamber which holds said first liquid outlet and said second inlet in a separated condition within said chamber, wherein a suction applied at, on or about said second liquid outlet induces a flow of liquid pulled from the liquid reservoir through said first and second ducting, and wherein said first ducting is arranged to direct the flow of liquid immediately before said first liquid outlet in a direction to said second inlet, such that the inertia of liquid leaving the first ducting through said first liquid outlet establishes an unducted portion of said flow of liquid from said first liquid outlet to said second inlet, wherein said reservoir is a container with a mouth region opening substantially sealed for use by a closure portion of said chamber, save for at least one pressure equalization opening for said reservoir means and said first liquid outlet.

2. A novelty drinking apparatus as defined in claim 1, wherein said first liquid outlet is provided through said closure portion of said chamber.

3. A novelty drinking apparatus as defined in claim 1, wherein said pressure equalization means is an aperture extending from the outer bounds of the reservoir.

4. A novelty drinking apparatus as defined in claim 1, wherein said pressure equalization means is an opening to the atmosphere through the interface of the mouth region of the reservoir and the chamber.

5. A novelty drinking apparatus as defined in claim 1, wherein said reservoir means and said chamber are cylindrical in shape and engaged to each other in a coaxial relationship.

* * * * *